US008974095B2

(12) United States Patent
Bortolato et al.

(10) Patent No.: US 8,974,095 B2
(45) Date of Patent: Mar. 10, 2015

(54) COUPLING COMPONENT FOR LIGHTING DEVICES

(75) Inventors: Daniele Bortolato, Cappella di Scorzè (IT); Maurizio Campobasso, Casier (IT); Daniele Nascimben, Silea (IT); Raffaele Piva, Treviso (IT)

(73) Assignee: Osram AG, Munich (DE)

( * ) Notice: Subject to any disclaimer, the term of this patent is extended or adjusted under 35 U.S.C. 154(b) by 273 days.

(21) Appl. No.: 13/497,057

(22) PCT Filed: Sep. 17, 2010

(86) PCT No.: PCT/EP2010/063678

§ 371 (c)(1), (2), (4) Date: Mar. 20, 2012

(87) PCT Pub. No.: WO2011/036099

PCT Pub. Date: Mar. 31, 2011

(65) Prior Publication Data

US 2012/0176807 A1 Jul. 12, 2012

(30) Foreign Application Priority Data

Sep. 23, 2009 (IT) ..... TO2009A0725

(51) Int. Cl.

| | |
|---|---|
| ***B65D 41/18*** | (2006.01) |
| ***H01J 5/60*** | (2006.01) |
| ***H01K 1/46*** | (2006.01) |
| ***H01K 1/58*** | (2006.01) |

(52) U.S. Cl.

CPC ... *H01J 5/60* (2013.01); *H01K 1/46* (2013.01); *H01K 1/58* (2013.01)

USPC ..... 362/441; 362/549; 362/433; 362/443; 362/448; 362/457; 220/792

(58) Field of Classification Search

CPC ..... B65D 43/0206; B65D 43/0204; B65D 43/0208

USPC ..... 362/549, 433, 441, 443, 448, 457, 458; 220/792

See application file for complete search history.

(56) References Cited

U.S. PATENT DOCUMENTS

| | | | | |
|---|---|---|---|---|
| 4,300,073 | A | 11/1981 | Skwirut et al. | |
| 4,335,827 | A * | 6/1982 | Knize et al. | 220/284 |
| 5,220,235 | A | 6/1993 | Wakimizu et al. | |
| 6,607,290 | B2 | 8/2003 | Matsuba et al. | |
| 8,091,732 | B2 * | 1/2012 | Bryson et al. | 220/792 |

(Continued)

FOREIGN PATENT DOCUMENTS

| | | | |
|---|---|---|---|
| CN | 1341952 | A | 3/2002 |
| JP | 10334860 | A | 12/1998 |
| WO | 0231851 | A1 | 4/2002 |

OTHER PUBLICATIONS

English Language Abstract of JP 10334860 A.

(Continued)

*Primary Examiner* — Ismael Negron

(57) ABSTRACT

A coupling component has a groove for receiving a rim of a mouth portion of a lighting body protection bulb. The groove includes sculptured formations to keep the mouth portion rim received in the groove spaced from the bottom of the groove to produce a discontinuous contact between the mouth portion rim and the groove.

10 Claims, 5 Drawing Sheets

(56) References Cited

U.S. PATENT DOCUMENTS

| | | | | |
|---|---|---|---|---|
| 2004/0245261 | A1* | 12/2004 | Stanos et al. | 220/793 |
| 2006/0000842 | A1* | 1/2006 | Maxwell | 220/780 |
| 2009/0108006 | A1* | 4/2009 | Milan | 220/592.17 |
| 2011/0266294 | A1* | 11/2011 | Charbonnet et al. | 220/711 |
| 2012/0168338 | A1* | 7/2012 | Wu et al. | 220/781 |

OTHER PUBLICATIONS

Office action and English translation dated Jul. 14, 2014 issued for the corresponding Chinese application.

* cited by examiner

COUPLING COMPONENT FOR LIGHTING DEVICES

RELATED APPLICATIONS

The present application is a national stage entry according to 35 U.S.C. §371 of PCT application No.: PCT/EP2010/063678 filed on Sep. 17, 2010, which claims priority from Italian application no. TO2009A000725 filed on Sep. 23, 2009.

TECHNICAL FIELD

Various embodiments relate to lighting devices of the integrated type including a light source, such as a halogen lamp, and a corresponding power supply circuit such as an electric transformer.

BACKGROUND

Figure 1:
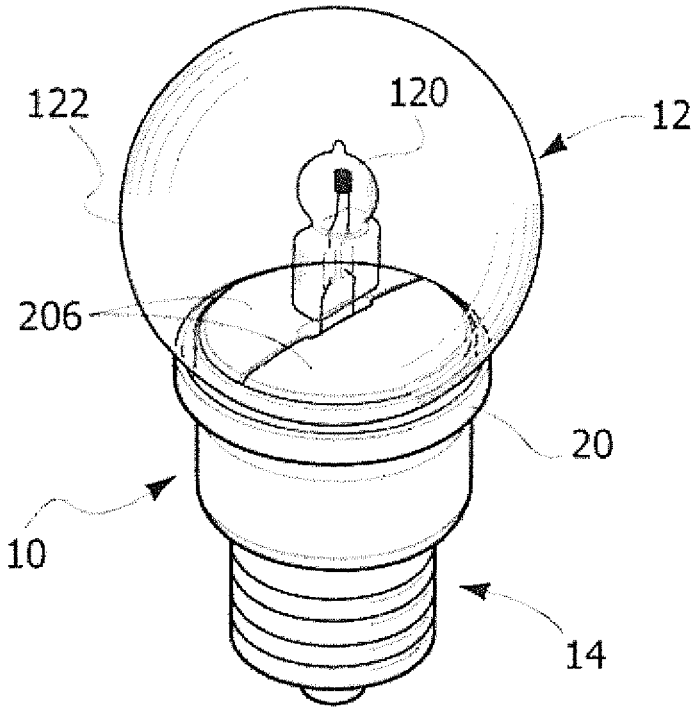
FIG. 1 Prior Art

FIG. 1 shows schematically, by way of example, a lighting device 10 comprising:

a light source 12 and a corresponding electrical power supply circuit 14.

The light source can comprise a lighting body (or "burner") which may be, for example, a halogen lamp 120 intended to reach temperatures of about 200° C. during operation. Consequently, while it is normally provided with its own bulb, of teardrop shape for example, the lamp 120 can be placed inside a bulb 122 made from transparent material (such as glass) which is intended to ensure that the flow of light is not impeded, while also preventing any undesired accidental contact with the lighting body 120 at its operating temperature.

The joint or connection to the housing containing the electrical power supply circuit 14 is made by means of a joining element 20 generally referred to as "tape".

To ensure that the heat originating from the light source 12 (in other words, from the lighting body 120) does not degrade the properties of the component 20, this component is made from materials which combine the properties of heat-resistance and stability (such as glass, ceramic materials or metals). However, these materials can give rise to problems in respect of weight, cost and low mechanical strength (for example, materials such as glass or ceramics have an intrinsically low resistance to impact), and are also difficult to model or mold. If plastics or resin materials are used, this may give rise to the release of chemical substances which can be deposited on the bulb 122, which, on the one hand, reduces the transparency of the bulb, impeding the diffusion of the light flux, and, on the other hand, imparts a stained appearance to the bulb, with negative results in terms of its visual appeal.

SUMMARY

The inventors have discovered that, in order to produce the component in question, it is necessary to provide solutions which can replace materials such as glass, ceramic materials or metal, and which are lighter, more economical and stronger in mechanical terms, while also being easier to model or mold because they are made from a material with excellent thermal insulation properties, such as plastics material, which can be used without giving rise to the other drawbacks described above.

The claims form an integral part of the technical teachings provided herein in relation to the invention.

Various embodiments can provide a very simple solution which has no appreciable effect on the production of the housing of an integrated lighting device.

Various embodiments can provide a compact solution which has no effect on the lighting device and which allows the lighting device to be given an appearance which is identical or at least very similar to that of a conventional bulb lamp.

Various embodiments also provide a good circulation of air between the external environment and the interior of the bulb, thus simultaneously reducing the temperature inside the bulb and allowing the exit of any chemical particles diffused inside the bulb, while also making it possible to provide the minimum safety distances and prevent any contact with the "live" parts of the lighting device by a correct design of the shape of the housing.

BRIEF DESCRIPTION OF THE APPENDED DRAWINGS

Figure 2:
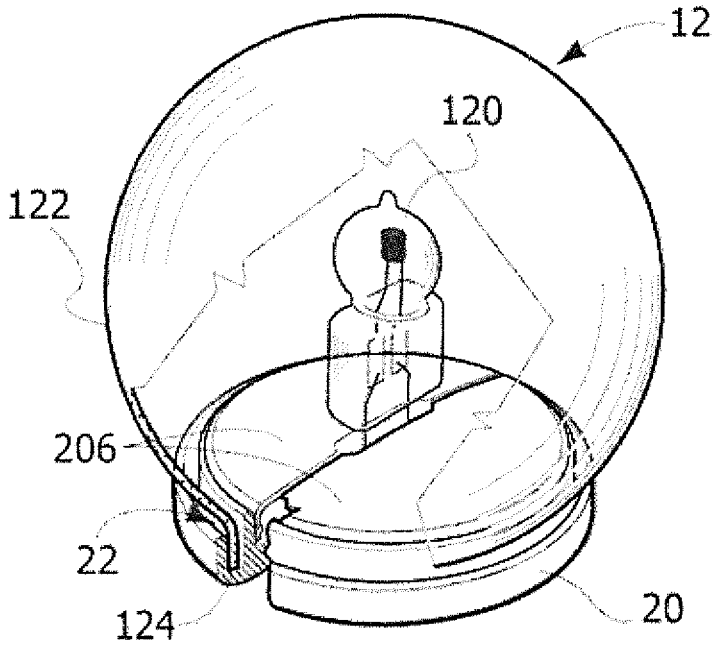
FIG. 2 Prior Art
Figure 3:
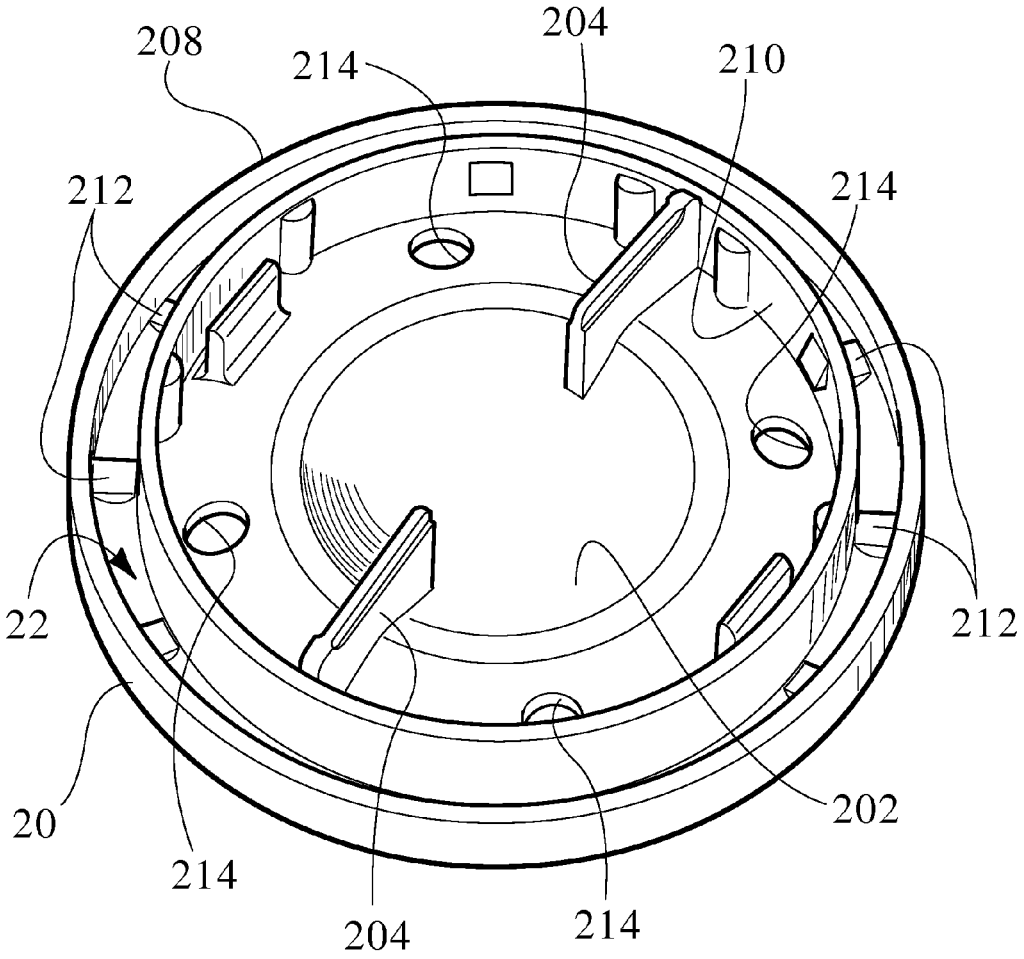
Figure 4:
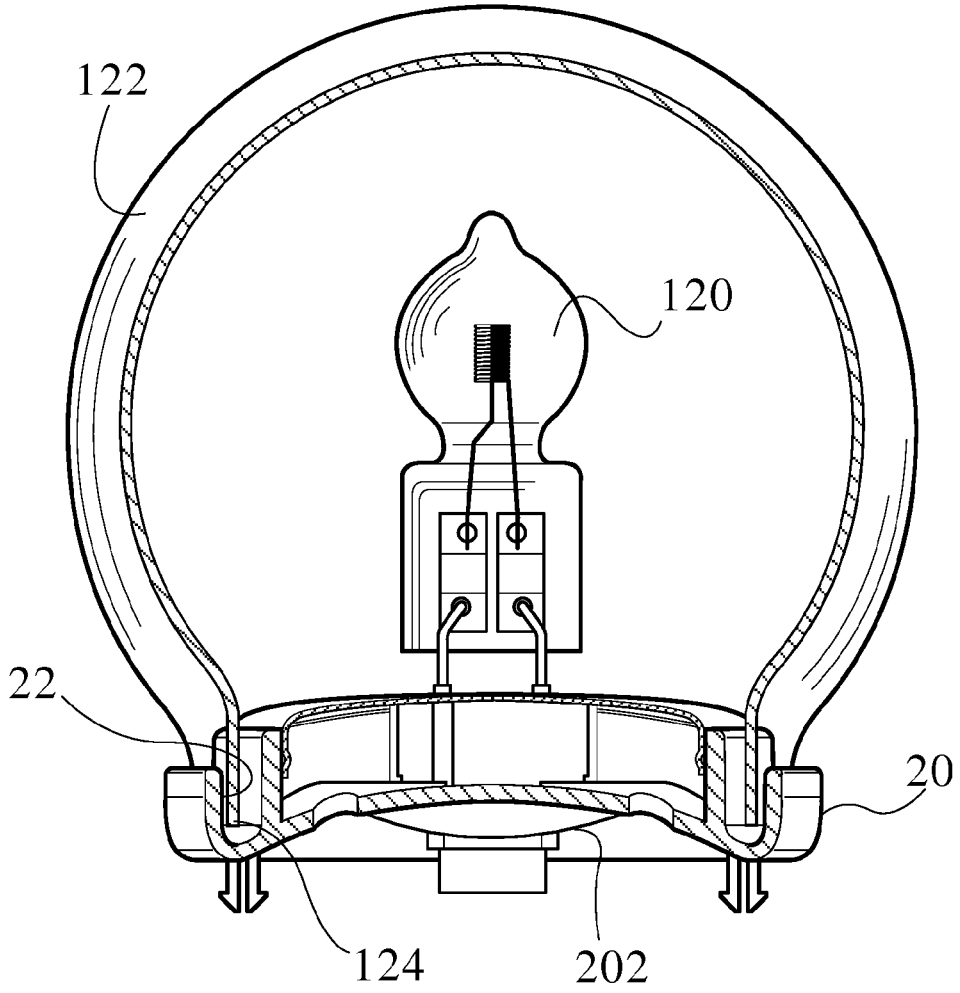
Figure 5:
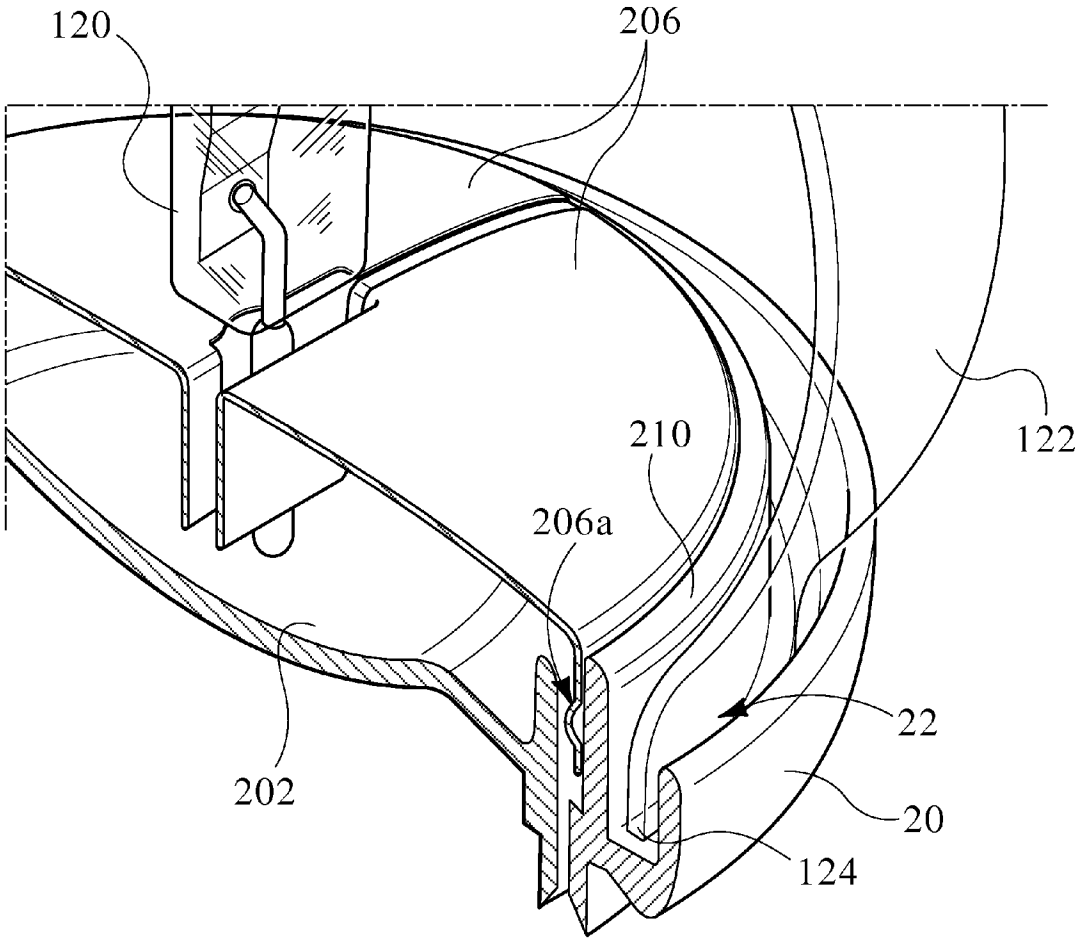
Figure 6:
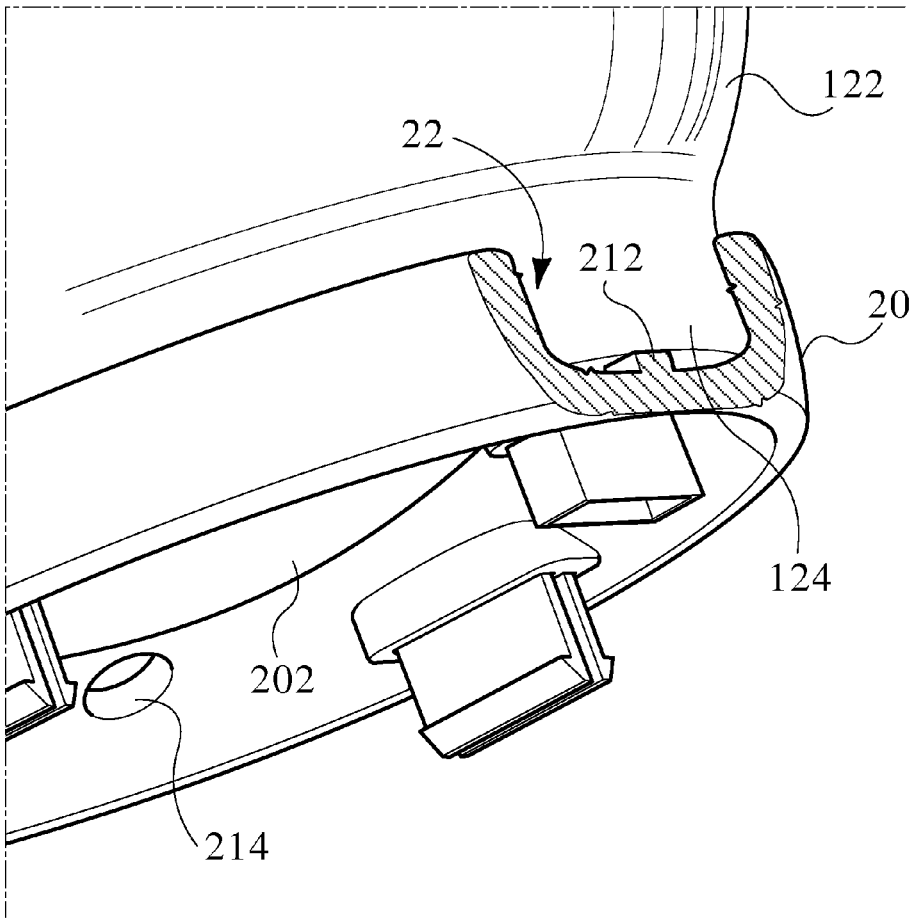

In the drawings, like reference characters generally refer to the same parts throughout different views. The drawings, are not necessarily to scale, emphasis instead being generally upon illustrating the principles of the invention. In the following description, various embodiments are described with reference to the following drawings, in which:

FIG. 1 has been described above,

FIG. 2 shows the position of the element considered herein within the device of FIG. 1, FIG. 3 shows a component according to one embodiment, considered separately, FIGS. 4, 5 and 6 show different modes of operation of embodiments, and

DETAILED DESCRIPTION OF EMBODIMENTS

The following description refers to the accompanying drawings that show, by way of illustration, specific details and embodiments in which the invention may be practiced.

The reference to "an embodiment" in this description is intended to indicate that a particular configuration, structure or characteristic described in relation to the embodiment is included in at least one embodiment. Therefore, phrases such as "in an embodiment", which may be present in various parts of this description, do not necessarily refer to the same embodiment. Furthermore, specific formations, structures or characteristics may be combined in a suitable way in one or more embodiments.

The references used herein are purely for convenience and therefore do not define the scope of protection or the extent of the embodiments.

FIG. 2 shows in greater detail the structure of the light source 12 described previously with reference to FIG. 1.

As stated previously, the light source 12 comprises a lighting body proper 120 (such as a halogen lamp, also called a "burner") surrounded by a bulb 122 of approximately spherical or bulb-like shape with an overall tray-like or cup-like structure (which appears inverted in the view shown in FIG. 2). The bulb 122 also has a mouth rim 124 (which is circular in the embodiment illustrated herein) designed to be received in a peripheral groove 22 of the component (generally called a "tape") indicated by 20 in FIG. 1 which was described above. As can be seen more clearly in the view of FIG. 3, in the embodiment illustrated herein the component 20 is of generally disk-like shape with a bottom wall 202 of overall concave shape designed to define an area for the mounting of the lighting body 120 in a central position and therefore on the bottom part of the bowl formed by the wall 202.

For example, two radial ribs 204 can extend upward from the bottom wall of the component 20 to permit the insertion, with a positive connection, of a two-piece plate 206 in the shape of an inverted tray, which carries the lighting body 120 in a central position.

The view of FIG. 3 also shows that the groove 22 intended to receive the mouth rim 124 of the bulb 122 lies between two annular walls, namely:

an "outer" annular wall 208, defining the external profile of the general disk-like configuration of the component 20, and an "inner" annular wall 210, which delimits peripherally the central part of the bottom wall 202 of the component 20. Between the two annular walls 208 and 210 there are radial ribs 212 forming raised (or more generally "sculptured") formations in relation to the bottom of the groove 22. Because of the presence of these formations 212, the coupling of the bulb 122 to the component 20 by the insertion of its mouth rim 124 into the groove 22 does not create any continuous contact between the mouth rim 124 and the bottom of the groove 22. In other words, the formations 212 help to keep the mouth rim 124 of the bulb 122 slightly "elevated" above the bottom of the groove 22, thus ensuring that the contact between the mouth rim 124 and the body of the component 20 is actually a discontinuous contact, which is, for example, capable of allowing a certain amount of air to flow between the mouth rim 124 of the bulb 122 and the peripheral edge of the component 20.

The reference 214 also indicates a set of openings provided in the bottom wall 202 of the component 20 such that a further flow of air is permitted between the external environment and the interior of the bulb 122.

As can be seen more clearly in the views of FIGS. 5 and 6, in various embodiments, the mouth rim 124 of the bulb 122 is inserted into the groove 22 and, because of the presence of the ribs 212, this insertion does not create a sealed connection but allows a degree of circulation of air in the internal environment of the bulb, such that the temperature inside the bulb can be reduced, and at the same time any chemical particles which have diffused into the bulb can pass out of it.

Thus a form of labyrinth is created between the parts concerned, this labyrinth allowing a flow of air but also meeting the requirements of electrical insulation in terms of creepage and clearance.

In various embodiments, the component 20 makes it possible to overcome the problems related to the high temperature of the lighting body 120 and to the fact that, when inserted into the bulb 122, the lighting body 120 is not directly exposed to the external environment and is therefore not directly ventilated.

As stated above, the component 20 can support the plate composed of two complementary portions 206 of semicircular shape, which also provide an electrical connection between the lighting body 120 and the other parts of the device 10, for example by means of edge portions bent to lie behind the inner face of the wall 210. In particular, the electrical connection can be made by means of blade contact elements as described in a patent application for an industrial invention filed on the same date by the present applicant.

In various embodiments, the component 20 is made from a plastics material with properties of high heat-resistance, for example the material known as LCP.

The component 20, and particularly the bottom wall 202, is also suitable for forming the mechanical connection with the power supply circuit 14 using a solution in which a separating air gap is formed as described in another patent application for an industrial invention filed on the same date by the present applicant.

The bulb 122 can be fixed to the component 20 by gluing or simply by means of a mechanical friction fit.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency if the claims are therefore intended to be embraced.

The invention claimed is:

1. A coupling component configured to hold a lighting body inserted in a protection bulb via a mouth portion of the bulb, said component comprising a groove for receiving the rim of said mouth portion of said bulb, said groove including sculptured formations to keep said mouth rim received in said groove spaced from the bottom of said groove to produce a circumferentially discontinuous contact between said mouth rim and said groove.

2. The component as claimed in claim 1, configured such that said sculptured formations are ribs emerging from said groove.

3. The component as claimed in claim 1, wherein said groove is shaped to be couplable to support elements for said lighting body in said bulb.

4. The component as claimed in claim 1, configured such that said groove lies between two annular walls of said component.

5. The component as claimed in claim 1, connected to said bulb via gluing or mechanical coupling.

6. The component as claimed in claim 1, made from a heat-resistant plastics material.

7. The component as claimed in claim 6, wherein the heat-resistant plastics material is LCP material.

8. The component as claimed in claim 1, said sculptured formations including ventilation openings to permit air flow with respect to the interior of said bulb.

9. The component as claimed in claim 8, having an try-like shape with a bottom wall with said ventilation openings provided in said bottom wall.

10. The component as claimed in claim 8, with said ventilation openings angularly distributed around the component.

* * * * *

UNITED STATES PATENT AND TRADEMARK OFFICE

CERTIFICATE OF CORRECTION

PATENT NO. : 8,974,095 B2
APPLICATION NO. : 13/497057
DATED : March 10, 2015
INVENTOR(S) : Daniele Bortolato et al.

It is certified that error appears in the above-identified patent and that said Letters Patent is hereby corrected as shown below:

In the Specification

1. Please amend the phrase "...circuit such as an electric transformer." in column 1, line 16 to read as follows: "...circuit such as an electronic transformer."

2. Please replace the heading "Detailed description of embodiments" in column 2, line 36, with the following new heading: "Detailed description".

3. After the paragraph in column 2 that begins on line 38 with "The following description refers..." and before the paragraph in column 2 that begins on line 41 with "The reference to "an embodiment"", please insert the following paragraph:

--The following description illustrates various specific details intended to provide a deeper understanding of the embodiments. The embodiments may be produced without one or more of the specific details, or with other methods, components, materials, etc. In other cases, known structures, materials or operations are not shown or described in detail, in order to avoid obscuring various aspects of the embodiments.--

In the Claims

4. Please amend the phrase "...to be couplable..." in column 4, claim 3, line 39, to read "...to be coupled..."

Signed and Sealed this
Twenty-first Day of July, 2015

Michelle K. Lee

Michelle K. Lee
*Director of the United States Patent and Trademark Office*